United States Patent [19]

Höfer

[11] 4,168,690

[45] Sep. 25, 1979

[54] FUEL INJECTION SYSTEM HAVING TIMING PISTON RESPONSIVE TO LOAD DEPENDENT PRESSURE SIGNAL

[75] Inventor: Gerald Höfer, Weissach-Flacht, Fed. Rep. of Germany

[73] Assignee: Robert Bosch GmbH, Stuttgart, Fed. Rep. of Germany

[21] Appl. No.: 826,628

[22] Filed: Aug. 22, 1977

[30] Foreign Application Priority Data

Oct. 2, 1976 [DE] Fed. Rep. of Germany ..... 2644699

[51] Int. Cl.[2] ..... F02M 39/00

[52] U.S. Cl. ..... 123/139 AQ

[58] Field of Search ..... 123/139 AQ, 139 AP, 123/140 FP

[56] References Cited

U.S. PATENT DOCUMENTS

| | | | |
|---|---|---|---|
| 3,815,564 | 6/1974 | Suda et al. | 123/139 AQ |
| 3,906,916 | 9/1975 | Laufer | 123/139 AP |
| 3,910,724 | 10/1975 | Okamoto | 123/139 AQ |
| 3,943,902 | 3/1976 | Skinner | 123/139 AQ |
| 4,050,433 | 9/1977 | Tokashiki | 123/139 AQ |

*Primary Examiner*—Carlton R. Croyle
*Assistant Examiner*—Thomas I. Ross
*Attorney, Agent, or Firm*—Edwin E. Greigg

[57] ABSTRACT

A fuel injection system, in which an adjustment in the fuel injection point, which is dependent on the load, is accomplished by controlling the pressurized fluid with a regulator sleeve, which dams the fuel quantity diverted by the regulator sleeve in order to conduct this dynamic pressure to the fuel injection point adjusting piston or to the pressure control valve, to influence the control pressure therewith.

3 Claims, 2 Drawing Figures

FUEL INJECTION SYSTEM HAVING TIMING PISTON RESPONSIVE TO LOAD DEPENDENT PRESSURE SIGNAL

BACKGROUND OF THE INVENTION

The invention relates to improvements in devices of the type shown in the Laufer U.S. Pat. No. 3,906,916 issued Sept. 23, 1975. This familiar fuel injection system presupposes that an r.p.m. dependent adjustment means is available for the load dependent variation of the pressure to effect the adjustment of the initial fuel injection time point. If, for example, the given r.p.m. dependent adjustment is zero or very small, then difficulties ensue, during a large load dependent adjustment, regarding the quantitative balance of the fuel supply pump and the design of the restoring spring of the fuel injection adjusting piston.

OBJECT AND SUMMARY OF THE INVENTION

The principal object of the fuel injection system of the present invention has the advantage that a load dependent adjustment of the initial injection point is possible even without an r.p.m. dependent adjustment of the positioning member.

Also, according to the invention and depending on the given internal combustion engine for which the fuel injection system is intended, it can be desirable to shift the initial fuel injection point with an increasing load to an earlier or later point in time.

Still another object of this invention is to provide a means for applying dynamic pressure through a control line to a pressure control valve.

These and other objects and advantages of the present invention will become apparent from the ensuing specification and claims when read in conjunction with the drawing.

The invention will be better understood as well as further objects and advantages become more apparent from the ensuing detailed specification of a preferred, although exemplary embodiment taken in conjunction with the drawing.

DESCRIPTION OF THE PREFERRED EMBODIMENT

Figure 1:
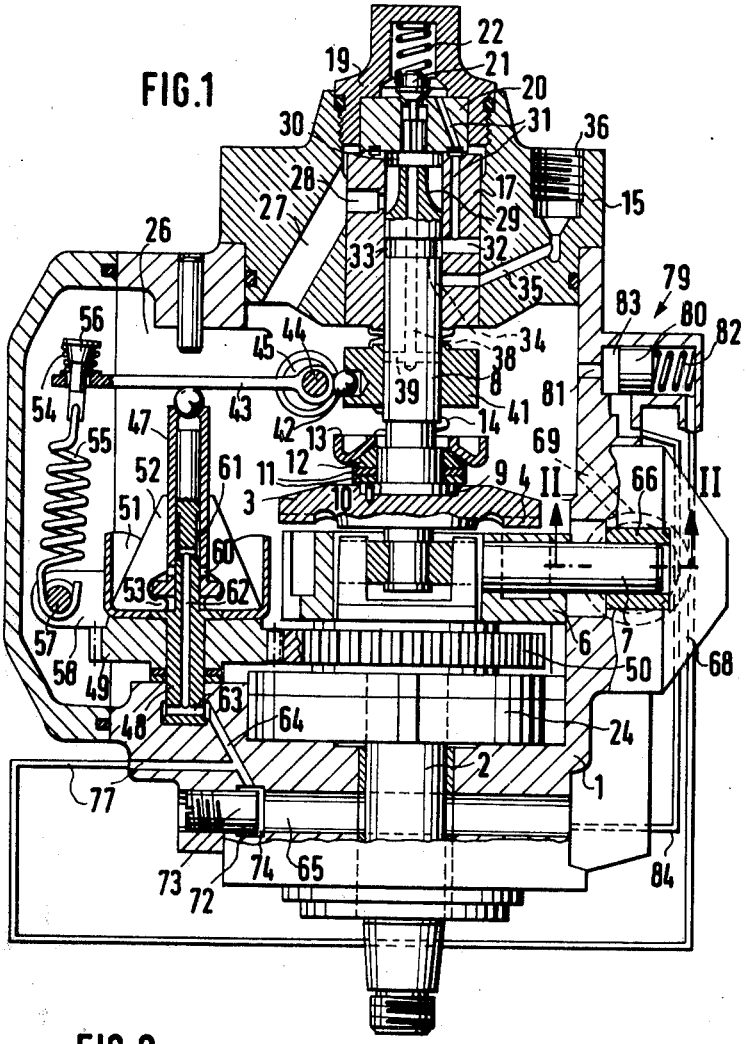
FIG. 1 is a sectional view of the fuel injection apparatus incorporating the preferred embodiment and FIG. 2 is a sectional view of same components taken along line II—II of FIG. 1.

Turning now to FIG. 1, in a housing 1 of a fuel injection pump serving a multicylinder internal combustion engine (not shown) there is supported a drive shaft 2 coupled with a cam disc 3 which carries as many camming protrusions 4 as there are cylinders in the engine. The track of the cam disc 3 is engaged by rollers, not shown, which are held in a ring 6. The latter is inserted into the pump housing 1 and is rotatable about the axis of the shaft 2 by means of a pin 7 extending into the ring 6. A fuel pumping and distributing member 8 has, at its side adjacent its drive means, a collar 9 which is coupled with the cam disc 3 by means of a pin 10.

On the collar 9 there are disposed in a face-to-face relationship two sliding discs 11 and an upwardly spherical disc 12 against which there is pressed a complemental counterface of a yoke 13 by means of two axially parallel coil return springs 14 (only one shown) disposed at 180° with respect to the axis of the pump. The return springs 14 engage a pump block 15 which is inserted in a fluid tight manner in an opening of the pump housing 1. Under the effect of the springs 14 the cam disc 3 is continuously pressed against the rollers supported by the ring 6.

The pumping and distributing member 8 is slidably situated in a cylinder sleeve 17 which is fixedly inserted into the pump block 15. The latter is closed at the top by a threaded cap 19 which presses a valve seat body 20 against the edge face of the cylinder sleeve 17. In an axial bore of the valve seat body 20 there is slidably arranged a movable valve member 21 which, in its closed position, is pressed against the valve seat body 20 by means of a spring 22 seated in a cavity of the closure cap 19.

To the pump shaft 2 there is affixed a rotary positive displacement pump 24 which serves as a fuel supply pump and which delivers fuel directly into the inner chamber 26 formed in the housing 1. From the inner chamber 26 there extends a channel 27 which leads to an inlet channel 28 in the cylinder sleeve 17. The inlet channel 28 cooperates longitudinal grooves 29 provided in the lateral face of a terminal portion of the pumping and distributing member 8. The longitudinal grooves 29 communicate with a pump work chamber 30 controlled by the pressure valve 20, 21. From the cavity of the threaded cap 19 which is disposed downstream of the valve 20, 21, there extends a channel 31 which passes through the valve seat body 30 and the wall of the cylinder sleeve 17 and which opens into a radial channel 32 provided in the cylinder sleeve 17. The channel 32 cooperates with an annular groove 33 of the pumping and distributing member 8. From the annular chamber 33 there extends, in the pumping and distributing member 8, an axially oriented distributor groove 34 which cooperates with the outlet channels 35 (only one shown). The latter are disposed radially with respect to the cylinder sleeve 17 and in an inclined manner in the pump block 15. They open into threaded coupling outlets 36 to which there are connected injection conduits (not shown) leading to the fuel injection nozzles (also not shown) of the internal combustion engine. Similarly to the camming protrusions 4 of the cam disc 3, the longitudinal grooves 29 and the outlet channels 35 with the coupling outlets 36 are equal in number to that of the cylinders of the internal combustion engine.

In the pumping and distributing member 8 there is provided an axial channel 38 which extends from the pump work channel 30 to a transversal channel 39. The mouths of the transversal channel 39 in the lateral face of the pumping and distributing member 8 cooperate with a control sleeve 41 which is axially displaceable on the pumping and distributing member 8. For causing an axial displacement of the control sleeve 41, into a depression of the latter there extends a spherical terminus of an arm 42 of a two-arm lever 42, 43 which is pivotally held on a pin 44. The pin 44 is disposed in an eccentric manner on the radial face of a shaft 45 which is supported in the pump housing 1 and which serves for the setting of the full load fuel quantities and for a fuel shut-off.

The other arm 43 of the two-arm lever 42, 43 is engaged by the spherical terminus of a governor member 47 of an rpm regulator which is slidable on a regulator shaft 48 fixedly attached to the housing 1. On the regulator shaft 48 there is rotatably mounted a spur gear 49 which meshes with a spur gear 50 keyed to the pump drive shaft 2. With the spur gear 49 there are fixedly connected sheet metal pockets 51 in which there are supported centrifugal weights 52. Each of the latter engages the governor member 47 by means of an arm 53.

The arm 43 of the two-arm lever 42, 43 is exposed to the force of a compression spring 54 and a tension spring 55 which serves as regulator springs. The compression spring 54 engages directly the lever arm 43 and is supported by a flaring pin 56. Into the pin 56 there is hooked one end of the tension spring 55, the other end of which is in engagement with a pin 57. The latter is affixed to a setting lever 58 which, for the purpose of adjusting the rpm to be regulated, is operable from the outside of the housing 1. The governor member 47 has radial openings 60 which cooperate with an annular groove 61 provided in the lateral face of the regulator shaft 48. The annular groove 61 is in continuous communication with a longitudinal bore 62 which opens into a transversal bore 63, both provided in the regulator shaft 48. The bore 63 is connected, by means of an oblique bore 64, with an inlet bore 65 which joins, in a manner not shown, the suction side of the fuel supply pump 24.

Figure 2:
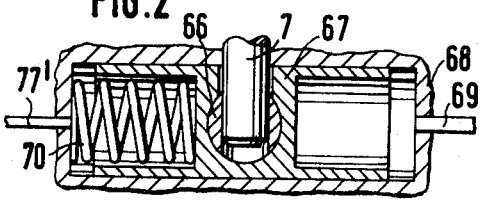

As best seen in FIG. 2, the pin 7 extends with its terminus projecting from the housing 1, into a cylindrical joint 66 which is rotatably arranged in a piston 67 of a hydraulic setting mechanism, the housing 68 of which adjoins the housing 1 of the fuel injection pump (FIG. 1). The piston 67 is exposed to the pressure prevailing in the inner chamber 26 of the housing 1 through a channel 69. The other terminal face of the piston 67 is engaged by a spring 70.

A device for throttling the fuel flow from the oblique bore 64 is located at the junction of the oblique bore 64 and the inlet bore 65. As shown the bore 64 leads into an annular groove 72 which communicates with the inlet bore 65 and an adjustable bolt 73 is arranged to be threadedly engaged in the bore and protrude into the annular groove 72. Thus it will be understood that the farther the bolt 73 is screwed inward, the smaller will become the remaining annular cross-section 74 between the fluid-filled chamber 72 and the bore 65. Branching off from the oblique bore 64 is a line 77 that conducts the fluid pressure dammed by the throttle to the devices described further below, in order to achieve the aforementioned load dependent adjustment of the initial injection point even at low r.p.m.

The pressure in the chamber 26 of the housing 1 is regulated by means of a pressure control valve 79 that includes a control piston 80 that is directly displaced in opposition to a spring 82 via a bore 81 by means of the fuel in the chamber 26. The control piston 80 therein opens the cross-sectional control area 83 to a greater or lesser degree. The fuel quantity diverted at the cross-sectional control area 83 flows via a return line 84 to the inlet bore 65 of the pump. By means of this pressure control valve 79, a pressure, which increases as the r.p.m. rises, is produced in the chamber 26.

According to the first embodiment of the invention as depicted in FIG. 1, the damming pressure produced by the throttle 74 is conducted via the line 77 to the spring side of the piston 80 of the pressure control valve 79.

According to another embodiment of the invention as shown in FIG. 2, the damming pressure is conducted via the line 77' to the spring side of the injection adjusting piston 67, which thereby causes a reversing of the effect.

OPERATION OF THE PREFERRED EMBODIMENT

When the internal combustion engine is running, the drive shaft 2 of the fuel injection pump rotates, causing rotation of the cam disc 3 which in cooperation with the rollers of the ring 6 effects an axial reciprocating motion and a simultaneous rotary motion of the pumping and distributing member 8. During this operation the cam disc 3 is maintained in continuous contact with the afore-noted rollers by means of the return springs 14. The pumping and distributing member 8 is shown in FIG. 1 in its lower dead center position. The pump work chamber 30 is charged with fuel through the inlet channel 28. As the cam disc 3 rotates first the inlet channel 28 is closed by the land of the pumping and distributing member 8. During the immediately following effective pressure stroke of the pumping and distributing member 8, fuel is delivered from the pump work chamber 30 through the open valve 20, 21, the channels 31 and 32 into the annular groove 33 and therefrom through the distributor groove 34 to one of the outlet channels 35 and then to the associated outlet coupling 36. Therefrom the fuel is admitted to the individual fuel injection nozzles of the internal combustion engine.

The fuel supply pump 24 supplies fuel into the inner chamber 26 of the fuel injection pump at an rpm-dependent pressure. The pressurized fuel exerts a force on the piston 67 of the hydraulic setting mechanism and thereby angularly adjusts in an rpm-dependent manner the ring 6 through the pin 7. The angular position of the ring 6 determines the beginning of injection start of the fuel injection pump.

As the rpm increases, the centrifugal weights 52 of the centrifugal regulator swing outwardly and displace the governor member 47 upwardly against the force of the regulator springs 54, 55. During this occurrence, first the spring 54 which serves for the regulation of the idling rpm, is compressed and thereafter the spring 55 serving for the regulation of the operational rpm is tensioned. During this displacement of the governor member 47, on the one hand, the control sleeve 41 is shifted downwardly so that the fuel quantities delivered by the fuel injection pump are decreased (partial load) and, on the other hand, the annular groove 61 of the regulator shaft is opened by the bores 60 of the governor member 47 so that more fuel may escape from the inner chamber 26 of the pump housing 1 and thus the pressure in the inner chamber 26 is reduced. During normal operation this also results in a change of the pressure that acts on the piston 67, and therewith causes a turning of the ring 6 which determines the initial feed point of the injection pump and consequently the initial injection time point.

Referring again to FIG. 1 the exposed cross-sectional area between the annular groove 61 and the bores 60 is therefore proportional to the position of the regulator sleeve 47 and hence to the load, i.e. to the injected fuel quantity. Accordingly it will be understood that the positions of the control slider 41 and of the regulator sleeve 47 hence are mutually proportional. The damming pressure in the line 77 produced by the cross-sectional throttle area 74 is accordingly also proportional to the load.

In the first embodiment of the present invention and as depicted in FIG. 1, the damming pressure which prevails in the line 77 supplements the force of the spring 82 in the pressure control valve 79. In order to keep the influence of the r.p.m. upon the injection point adjustment as small as possible in certain applications, the spring 82 is selected to be relatively soft. In this manner a greater quantity is discharged at higher r.p.m.'s without thereby substantially changing the pressure in the chamber 26. However, because the load department damming pressure supplements the spring 82, a corresponding variation of the pressure in the chamber 26 results as a dependent function of the load, thus causing a corresponding adjustment in the initial injection point.

In the second embodiment of the invention, depicted in FIG. 2, and in which the damming pressure acts upon the injection adjusting piston 67, the damming pressure varies with the load (regulator sleeve 47 is displaced), thereby resulting in a corresponding shift of the injection adjusting piston 67. During certain load conditions and according to the given setting of the cross-sectional throttle area 74, an equilibrium of the forces that act on the injection adjusting piston 67, namely the force due both to the diameter of the injection adjusting piston and the pressure in the interior chamber 26, and the force due both to the surface area of the injection adjusting piston and to the spring 70, can be achieved thereby.

What is claimed is:

1. In a fuel injection apparatus for internal combustion engines, including: a fuel supply pump; a housing defining an inner chamber into which fuel is delivered by the fuel supply pump; a pressure control valve connected to the inner chamber for controlling the pressure of the fuel in the inner chamber; a fuel injection pump delivering fuel from the inner chamber to the engine; an rpm regulator having an adjustable governor member; bore means controllable at one end by the adjustable governor member and connected at its other end to the suction side of the fuel supply pump; and a hydraulic setting mechanism which varies the moment of fuel delivery by the fuel injection pump as a function of the pressure in the inner chamber, the improvement comprising:

a control line connected to the pressure control valve and to said bore means downstream of its adjustable member control end; and an adjustable throttle connected to said bore means between that end thereof connected to the suction side of the fuel supply pump and that end thereof connected to said control line, whereby a damming pressure is produced in the bore means upstream of the throttle, which pressure is communicated to the pressure control valve by said control line, and whereby the damming pressure affects, through the pressure control valve, the pressure in the inner chamber and thereby the setting of the hydraulic setting mechanism.

2. The fuel injection apparatus as defined in claim 1, wherein the pressure control valve includes: a spring chamber connected to the control line; a spring situated in the spring chamber; a pressure chamber; means connecting the pressure chamber to the inner chamber; further means connecting the pressure chamber to the suction side of the fuel supply pump; and a control piston situated between the spring chamber and the pressure chamber, and defining opposed surfaces against which the spring force and the pressure in the pressure chamber act, respectively.

3. In a fuel injection apparatus for internal combustion engines, including: a fuel supply pump; a housing defining an inner chamber into which fuel is delivered by the fuel supply pump; a fuel injection pump delivering fuel from the inner chamber to the engine; an rpm regulator having an adjustable governor member; bore means controllable at one end by the adjustable governor member and connected at its other end to the suction side of the fuel supply pump; and a hydraulic setting mechanism which varies the moment of fuel delivery by the fuel injection pump as a function of pressure in the inner chamber, the improvement comprising:

a control line connected to the hydraulic setting mechanism and to said bore means downstream of its adjustable member control end; and an adjustable throttle connected to said bore means between that end thereof connected to the suction side of the fuel supply pump and that end thereof connected to said control line, whereby a damming pressure is produced in the bore means upstream of the throttle, which pressure is communicated to the hydraulic setting mechanism by said control line, and whereby the damming affects the setting of the hydraulic setting mechanism.

* * * * *